United States Patent [19]

Zandman et al.

[11] Patent Number: 4,677,413

[45] Date of Patent: Jun. 30, 1987

[54] PRECISION POWER RESISTOR WITH VERY LOW TEMPERATURE COEFFICIENT OF RESISTANCE

[75] Inventors: Felix Zandman, Philadelphia, Pa.; Joseph Szwarc, Tel Aviv, Israel

[73] Assignee: Vishay Intertechnology, Inc., Malvern, Pa.

[21] Appl. No.: 673,481

[22] Filed: Nov. 20, 1984

[51] Int. Cl.[4] ..... H01C 7/10

[52] U.S. Cl. ..... 338/7; 338/195; 338/306

[58] Field of Search ..... 338/5–7, 338/195, 279, 306–314; 73/862.65

[56] References Cited

U.S. PATENT DOCUMENTS

| | | | |
|---|---|---|---|
| 4,176,445 | 12/1979 | Solow | 338/195 X |
| 4,242,660 | 12/1980 | Cocca | 338/195 |
| 4,286,249 | 8/1981 | Lewis et al. | 338/195 X |
| 4,301,439 | 11/1981 | Johnson et al. | 338/195 |
| 4,378,549 | 3/1983 | Szwarc | 338/195 |
| 4,475,409 | 10/1984 | Zulliger | 73/862.65 |

*Primary Examiner*—Elliot Goldberg
*Assistant Examiner*—M. M. Lateef
*Attorney, Agent, or Firm*—Weiser & Stapler

[57] ABSTRACT

A precision resistor exhibiting a temperature coefficient of resistance which is very low and which is virtually independent of time, and capable of accepting high power, comprises a resistive foil applied to a substrate by means of an appropriate cement, wherein the coefficient of thermal expansion of the substrate is either at zero or as close to zero as is possible, and wherein the resistivity versus temperature characteristic of the foil selected is adjusted so as to compensate for the thermal strain induced change in resistance which results when the temperature of the assembly changes, and the device is reacting to the application of power virtually without creating a transient phenomenon due to the flow of heat. Also a method for producing such a precision resistor.

23 Claims, 11 Drawing Figures

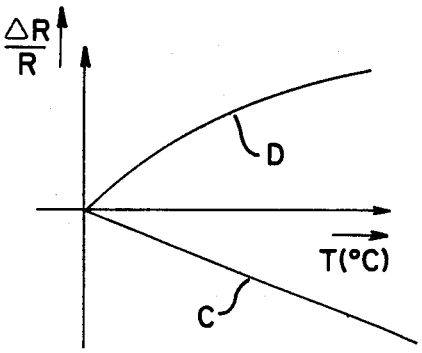
FIG. 1
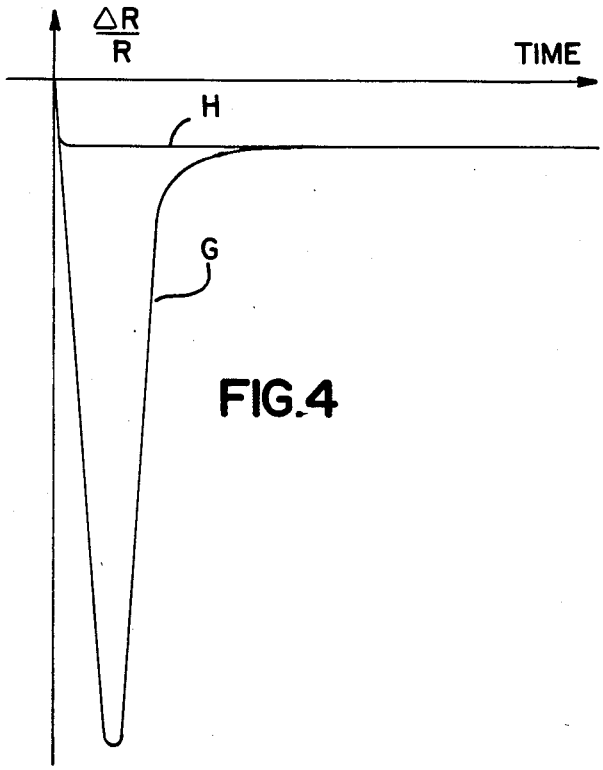
FIG. 4
FIG. 2
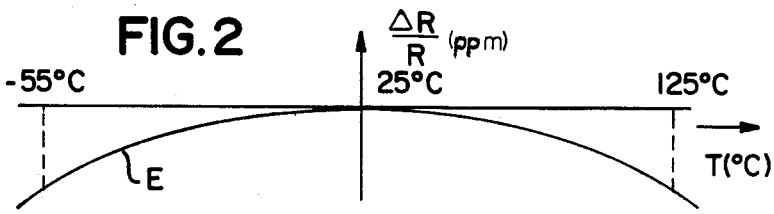
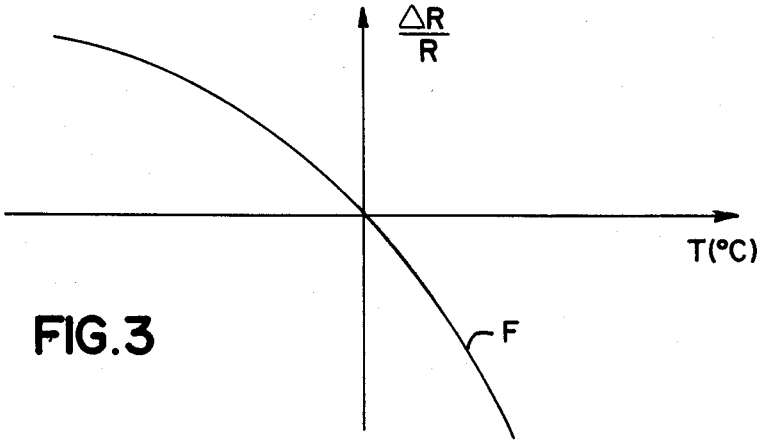
FIG. 3

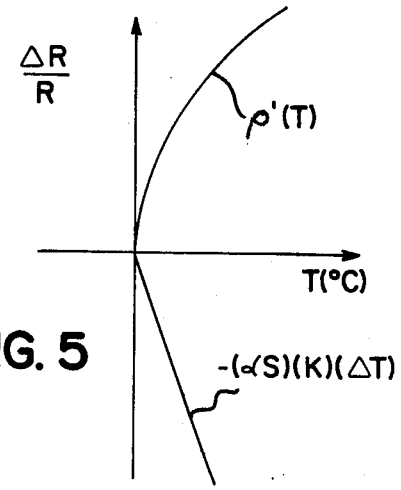
FIG. 5
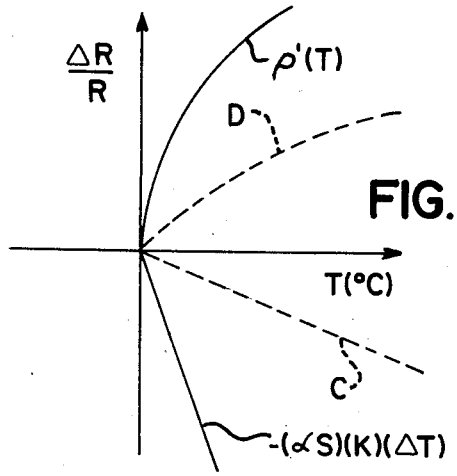
FIG. 7
FIG. 6
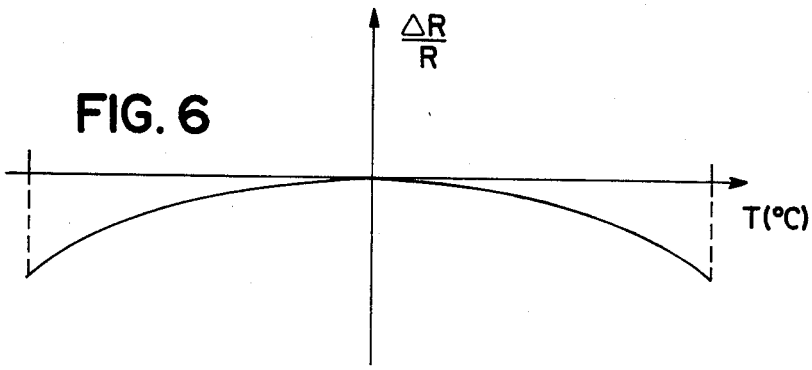
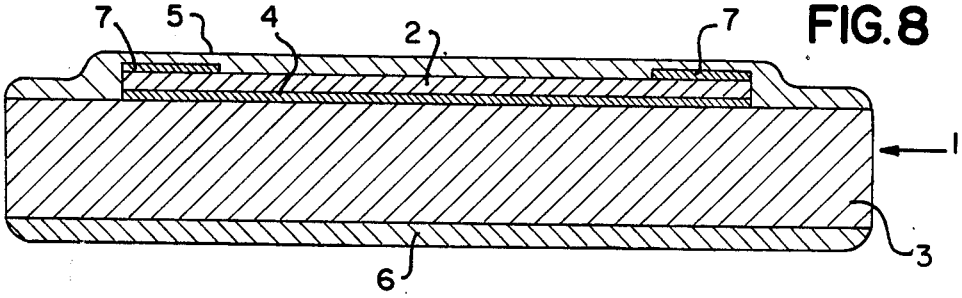
FIG. 8
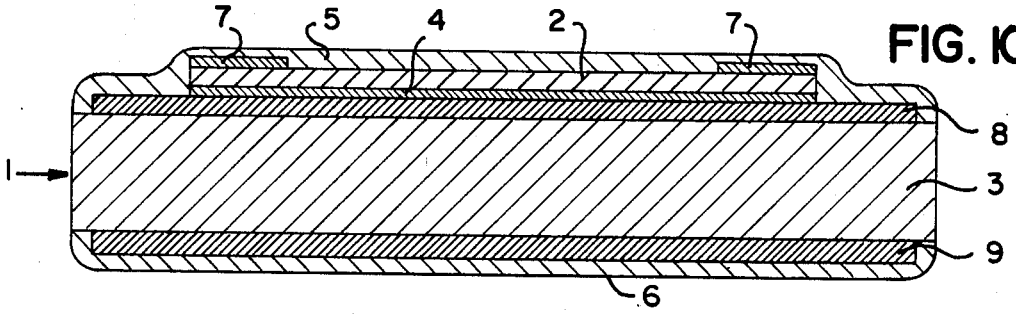
FIG. 10

PRECISION POWER RESISTOR WITH VERY LOW TEMPERATURE COEFFICIENT OF RESISTANCE

BACKGROUND OF THE INVENTION

The present invention relates generally to precision film resistors, particularly precision film-type power resistors.

A variety of applications require the development of highly precise resistances, which do not vary beyond prescribed tolerances over an acceptable temperature range. One resistor configuration which has found widespread use in this regard is the foil-type resistor, which generally comprises a resistive foil applied to an appropriate substrate. This is because such resistors have been found to be capable of achieving a low temperature coefficient of resistance (TCR). This is generally accomplished by making use of a foil resistive element wherein the foil's resistivity changes with temperature are capable of compensating for the strain induced resistance changes which are developed as a result of mismatch of the coefficients of thermal expansion of the resistive foil and of the substrate to which it is applied, as follows.

Strain ($\epsilon$) is capable of being expressed as a function of temperature and as a function of resistance, in accordance with the following equations:

$$\epsilon=(\alpha s-\alpha f)\Delta T \text{ (differential thermal expansion)} \quad (A)$$

$$\epsilon=1/K \cdot {}^{\Delta R}/R \text{ (strain gauge effect)} \quad (B)$$

wherein:

$\alpha s$ = coefficient of thermal expansion of the substrate material $\alpha f$ = coefficient of thermal expansion of the foil material K = a constant dependent upon the foil material.

Accordingly, in defining changes in resistance as a function of temperature:

$${}^{\Delta R}/R = K(\alpha s-\alpha f)\Delta T. \quad (C)$$

With reference to FIG. 1 of the drawings, it will be noted that by appropriate selection of the materials used, the characteristic defined in accordance with equation (C) is capable of being compensated by the foil's resistivity change with temperature $\rho(T)$(D). As illustrated in FIG. 2 at (E), such compensation is operational over a range of temperatures. However, such compensation is not perfect because $\rho(T)$ is non-linear while $K(\alpha s-\alpha f)\Delta T$ is essentially linear. Nevertheless, the resulting temperature coefficient of resistance is very low and very useful for precision applications.

Accordingly, as recognized in U.S. Pat. Nos. 3,405,381 and 3,517,436, issued in the name of Zandman et al, appropriate selection of the materials comprising the substrate and the resistive foil will enable a desired temperature coefficient of resistance to be developed over a certain temperature range. Further in accordance with the teachings of Zandman et al, additional improvement in precision is achieved by compensating the coating which is traditionally used to cover the foil applied to the substrate and the cement which attaches the foil to the substrate with a coating located on the opposite side of the substrate. Attempts to further improve upon the teachings of Zandman et al may be found with reference to U.S. Pat. No. 3,824,521, which teaches adjustment of the coefficients of thermal expansion, and U.S. Pat. No. 4,306,217, which teaches application of a rubber bead to portions of the substrate to absorb forces developed upon its expansion.

While the foregoing efforts have achieved satisfactory results in connection with relatively low power applications, satisfactory results have generally not been achieved when foil resistors of the type previously described were used in relatively high power applications. The reason for this is that unlike low power applications, the current which is applied to the resistive element in a high power application will, upon initiation, cause heating of the resistive foil without significantly heating the substrate to which the foil is attached. This results from differences in the materials used, as well as the thermal barrier which is generally created by the cement which is used to attach the resistive foil to the substrate.

As a result, upon initial application of current, e.g., within a few miliseconds, the foil becomes hot as a result of the current applied to it, while the substrate to which the foil is cemented remains approximately at the temperature it was assuming before the application of current. This is because of the thermal barrier formed by the cement. Even after the heat from the foil passes the cement layer, it will still take some time until all of the substrate becomes hot. During the period of transition between the initial application of current and the time when the entire substrate is at a steady state heat flow (temperature not changing with time), the temperature coefficient of resistance of the resistor will vary. At the time of current initiation, the foil will expand according to its coefficient of thermal expansion (e.g., $\alpha f=9\times10^{-6}/°F.$), while the substrate will not expand because it has not yet sensed the change in temperature. Hence, its expansion ($\alpha s$) will be zero. In such case, equation (C) will be written as:

$${}^{\Delta R}/R = K(0-\alpha f)\Delta T \quad (C')$$

Accordingly, there will be an overcompensation of the foil's resistivity $\rho(T)$ (curve D in FIG. 1), and the resulting temperature coefficient of resistance will be completely different from that shown in FIG. 2. In such case, the temperature coefficient of resistance will be as shown at F in FIG. 3. As time passes, the substrate will become hotter due to heat flow from the foil, and the temperature coefficient of resistance will get closer to its steady state value. Finally, when the substrate is at a steady state temperature, the temperature coefficient of resistance illustrated in FIG. 2 is achieved.

In connection with relatively low speed applications, such considerations presented little difficulty since there was ample time for the components of the resistor to approach temperature equilibrium. However, recent advances in technology have created a need for a precise power resistor which is capable of functioning in relatively high speed operations, and which is capable of establishing precision in the shortest possible period of time. Among various other applications, these include, for example, the application of laser technologies to the etching of integrated circuits as an alternative to the use of photographic masks and the like, the use of lasers for extra fast trimming of resistors, or the use of electron beams for pattern generation.

To illustrate the problem, reference is made to FIG. 4 of the drawings. My studies have found that in connection with a typical power application, resistance will typically vary ($^{\Delta R}/R$) as a function of time as shown at (G). Accordingly, during initial periods of operation, variations in resistance will be such as to preclude useful operation of the device. Only after this initial period passes will acceptable precision be established. For high speed operations, as well as low speed operations, an ideal resistance versus time characteristic such as is illustrated at (H) is desirable.

It has therefore remained to develop a precision power resistor which exhibits a temperature coefficient of resistance which is virtually independent of time and power.

SUMMARY OF THE INVENTION

It is therefore an object of the present invention to provide a precision power resistor which exhibits a temperature coefficient of resistance which is independent of time and power within the resistor's power handling capability.

These and other objects which will become apparent are achieved in accordance with the present invention by providing a precision resistor which generally comprises a resistive foil applied to a substrate by means of an appropriate cement, wherein the coefficient of thermal expansion of the substrate is essentially zero (either at zero or as close to zero as is possible), and wherein the resistivity versus temperature characteristic of the foil selected is adjusted so as to compensate for the strain induced change in resistance which results when the temperature of the assembly is changing. In such case, the substrate will not change dimension significantly as a result of heat generated by the application of current to the resistive element because $\alpha s=0$ or is close to zero.

The resistivity of the foil $\rho'$ (T) should now be adjusted so as to compensate for the following equation:

$$^{\Delta R}/R=K(0-\alpha f)\Delta T \text{ or } ^{\Delta R}/R=-(\alpha f)(K)(\Delta T) \qquad (C'')$$

Hence, with reference to FIG. 5, $\rho'(T)$ should be equal to or close to $-(\alpha f)(K)(\Delta T)$. As a result, the resistor will exhibit a very low temperature coefficient of resistance, as illustrated in FIG. 6, which will be the same at the time of current initiation and thereafter.

If power is increased, the heat in the foil will increase, but the substrate will not change dimensions because $\alpha s=0$ (or close to zero). Hence, the compensation shown in FIG. 6 will still be valid. FIG. 7 shows the difference in compensation between prior art foil resistor techniques for low power applications (shown in phantom) and the techniques described herein for high power applications (shown in solid lines).

For further detail regarding precision power resistors in accordance with the present invention, reference is made to the following detailed description of preferred embodiments, taken in conjunction with the following illustrations.

BRIEF DESCRIPTION OF THE DRAWINGS

FIG. 1 is a graph illustrating the manner in which resistivity changes with temperature may be used to compensate for the coefficients of thermal expansion of the resistive foil and the substrate of a precision resistor, at low power applications.

FIG. 2 is a graph illustrating such compensation as a function of temperature.

FIG. 3 is a graph similar to that illustrated in FIG. 2, but at high power applications, and during the short initial stage when the temperature difference between the foil and the substrate is much greater than at steady state.

FIG. 4 is a graph illustrating changes in resistance, over time, of a power resistor comprising a resistive foil and the substrate to which it is attached, also showing an ideal characteristic curve.

FIG. 5 is a graph similar to that illustrated in FIG. 1, for a power resistor in accordance with the present invention.

FIG. 6 is a graph similar to that illustrated in FIG. 2, showing compensation as a function of temperature for a power resistor in accordance with the present invention.

FIG. 7 is a composite of the graph of FIG. 1 and the graph of FIG. 6, for comparison purposes.

FIG. 8 is an elevational view of a precision power resistor produced in accordance with the present invention.

FIG. 10 is an elevational view of an alternative embodiment precision power resistor produced in accordance with the present invention, including an intermediate substrate to accommodate capacitance.

In the several views provided, like reference numerals denote similar structure.

DETAILED DESCRIPTION OF PREFERRED EMBODIMENTS

Figure 9:
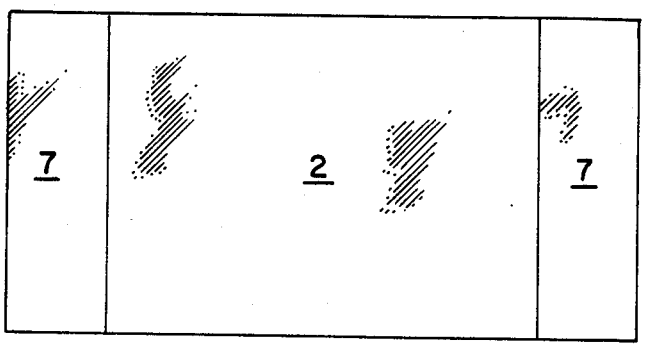
FIG. 9 is a plan view of an alternative embodiment precision power resistor produced in accordance with the present invention.

Although specific forms of the invention have been selected for illustration in the drawings, and the following description is drawn in specific terms for the purpose of describing these forms of the invention, this description is not intended to limit the scope of the invention which is defined in the appended claims.

FIG. 8 illustrates a precision power resistor 1 formed in accordance with the present invention. Resistor 1 generally comprises a resistive element 2 applied to a substrate 3 by means of an appropriate cement 4. The resistive element 2 is then preferably covered with an appropriate coating 5, as is conventional. In accordance with the teachings of U.S. Pat. Nos. 3,405,381 and 3,517,436, as previously referred to, a second coating 6 is also preferably applied to the substrate 3 on the side which is opposite to the resistive element 2.

It will be understood that further assembly of the power resistor 1 will proceed in accordance with techniques which are generally known in this art. This would include subsequent steps such as the application of connecting leads (not shown) to the resulting assembly, coating of the resulting assembly with additional protective materials, and ultimate encapsulation of the resulting assembly with an appropriate material to provide a completed precision resistor. For this reason, further description regarding such steps is unnecessary, and has not been provided.

In another embodiment, with reference to FIG. 9, the power resistor 1 can be made from a substrate 3 to which is cemented a resistive element 2 and to which leads (not shown) can be attached by means of copper plated regions 7 formed on the resistive element 2, for the uniform introduction of current from the leads to the resistive element 2. Coatings 5, 6 may or may not be applied to the resistive element 2 as previously described, depending upon circumstances.

Regarding materials, a number of resistive materials may be used to form the resistive element 2, including nickel chrome alloys and the like. Resistive element 2 will generally be of a thickness on the order of 30 to 300 microinches. In accordance with the present invention, selection of the material which is used to form the substrate 3 will depend upon the substrate's coefficient of thermal expansion, since this parameter is to be maintained either at zero or as close to zero as is possible. For example, metals including nickel iron alloys such as those marketed under the tradenames "Invar" (coef. of $1\times10^{-6}$/°F.) and "Super Invar" (coef. of about 0 to $\frac{1}{2}\times10^{-6}$/°F.), carbon (coef. of $-\frac{1}{2}$ to $\frac{1}{2}\times10^{-6}$/°F.), certain ceramic materials such as those marketed under the tradenames "Cermet" (coef. of $3\times10^{-6}$/°F.) and "Corderite" (coef. of about 0), and other materials having extremely low coefficients of thermal expansion are useful in this regard. The substrate 3 will generally be of a thickness on the order of 10 mils to 1 inch. The cement 4 used to attach the resistive element 2 to the substrate 3 must be extremely strong so as to be able to transmit the shear strain developed between the substrate 3 and the resistive element 2 without appreciable creep, since such shear strains will be developed every time there is a change in temperature of the elements involved. A variety of cements are useful in this regard including epoxies, polyimides, etc.

It will be understood that if a metallic substrate is used, such as to improve heat dissipation, for example, care must be taken to accommodate capacitance which may develop between the foil forming the resistive element 2 and the metal forming the substrate 3. With reference to FIG. 10, such difficulties may be overcome by cementing the resistive element 2 to an intermediate insulating substrate 8 which is a good heat conductor, but which is a poor electrical conductor, and by then cementing the insulating substrate 8 to the substrate 3. An insulating substrate 8 formed of alumina and having a thickness on the order of 4 mils to 40 mils, for example, serves well in this regard. Here again, the cement chosen must be able to transfer shear stress without creep since the shear stress will change every time the temperature changes.

Of course, the power resistor 1 must be constructed extremely carefully so as not to induce resistance changes resulting from external stresses, encapsulation coatings, pulling/twisting/bending of the resistor leads, or the like. Moreover, it is extremely important that the power resistor 1 be constructed with extreme care concerning symmetry. For example, in the event that the power resistor 1 makes use of a metallic substrate 3, and uses an insulating substrate 8 to ameloriate the effects of capacitance, it is important that a compensating substrate 9 be applied to the opposite side of the substrate 3 to avoid unacceptable bending resulting from differences in the coefficients of thermal expansion of the insulating substrate and the metallic substrate to which it is applied. The compensating substrate 9 may be formed of the same material as that forming the insulating substrate 8, or a different material which is compensating by virtue of its thickness, coeficient of thermel expansion, modulus of elasticity, etc. Further improvements in performance can be achieved if the power resistor 1 is actively cooled by external means. Such cooling will also allow the thickness of the substrate 3 to be reduced.

Figure 11:
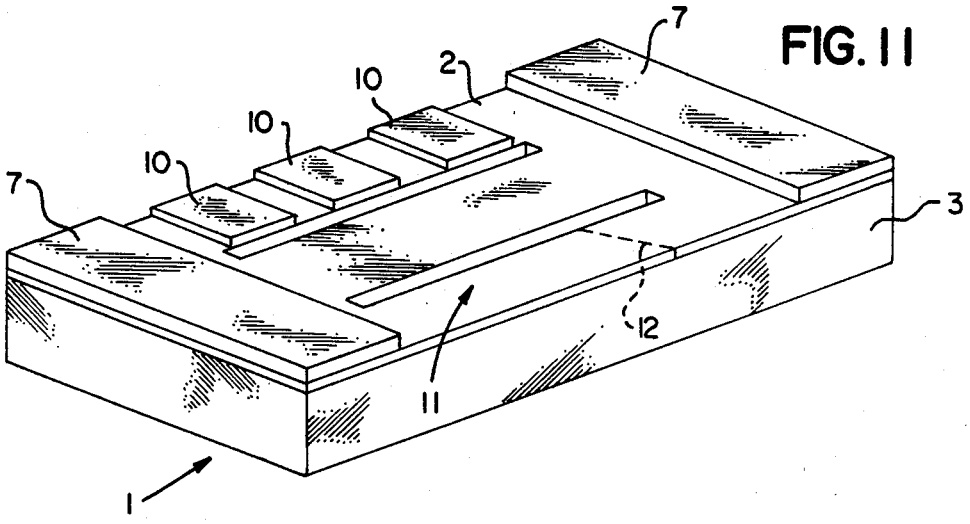
FIG. 11 is a perspective view of a precision power resistor produced in accordance with the present invention, and means for adjusting the temperature coefficient of resistance.

In accordance with the present invention, it is important that the resistivity versus temperature characteristic of the foil selected be adjusted so as to compensate for the strain induced change in resistance which results when the temperature of the assembly changes. If the foil's characteristic is not matched perfectly with the substrate's, the need may arise to slightly adjust the temperature coefficient of resistance of the resistive element 2 so as to develop a perfect match between the layer's resistivity change with temperature and the layer's thermal strain induced resistance changes. With reference to FIG. 11, this may be accomplished by plating portions of the resistive element 2 with a material having a high temperature coefficient of resistance, such as copper, nickel, gold, etc. If the plating 10 results in a temperature coefficient of resistance which is too high, further adjustment may be accomplished by removing portions of the plating 10 until the desired temperature coefficient of resistance is obtained. Such removal may be accomplished chemically or mechanically. In the alternative, adjustment may be accomplished by removing portions 11 of the resistive layer 2 from the electrical circuit by etching or cutting, as at 12. In this case, the temperature coefficient of resistance will increase. Adjustment of the temperature coefficient of resistance may also be achieved by placing a material having a high temperature coefficient of resistance in series and/or parallel combination with the resistive element 2.

In some applications, it may be desirable to apply a plurality of resistive elements 2 to a single substrate 3 to develop a plurality of resistors 1 on a single substrate. This may be accomplished either by applying a plurality of discrete resistive elements 2 to a single substrate 3, or by applying a single resistive element 2 to the substrate 3 and thereafter developing the separate elements desired by means of etching or otherwise. While convenient in many applications, such construction will generally necessitate adjustment to normalize the temperature coefficients of resistance of the various resistive elements 2 applied to the substrate 3, which adjustment may be accomplished as previously described.

It will be understood that various changes in the details, materials and arrangements of parts which have been herein described and illustrated in order to explain the nature of this invention may be made by those skilled in the art within the principle and scope of the invention as expressed in the following claims.

What is claimed is:

1. A resistor which exhibits a very low temperature coefficient of resistance and which is capable of accepting high power, said resistor comprising:

a substrate and a resistive foil attached to said substrate by a cement;

wherein said substrate is formed of a material having a coefficient of thermal expansion which is essentially zero; and wherein said foil is formed of a material having a resistivity versus temperature characteristic which compensates for strain induced changes in resistance in said foil resulting from changes in temperature of said resistor so that said temperature coefficient of resistance of the resistor remains essentially independent of time.

2. The resistor of claim 1 wherein said substrate is formed of a material having a coefficient of expansion of not more than approximately $2\times10^{-6}$/°F. and not less than approximately $-\frac{1}{2}\times10^{-6}$/°F.

3. The resistor of claim 2 wherein said substrate is a metal.

4. The resistor of claim 3 wherein said substrate has a thickness of from about 10 mils to about 1 inch.

5. The resistor of claim 2 wherein said substrate is an insulator.

6. The resistor of claim 5 wherein said substrate has a thickness of from about 10 mils to about 200 mils.

7. The resistor of claim 2 wherein said substrate is carbon.

8. The resistor of claim 1 wherein said resistive foil is a nickel chrome alloy.

9. The resistor of claim 8 wherein said foil has a thickness of from about 30 microinches to about 300 microinches.

10. The resistor of claim 1 wherein the temperature coefficient of resistance of said resistor is essentially constant over time.

11. The resistor of claim 10 wherein said temperature coefficient of resistance is essentially constant in the millisecond range.

12. The resistor of claim 1 which further comprises an insulating substrate interposed between the substrate and the resistive foil.

13. The resistor of claim 12 wherein the insulating substrate is formed of alumina.

14. The resistor of claim 13 wherein the insulating substrate has a thickness of from about 4 mils to about 40 mils.

15. The resistor of claim 12 wherein a layer of material having expansion characteristics which are capable of compensating bending caused by the insulating substrate is formed on a side of the substrate opposite to the side which is provided with the insulating layer.

16. The resistor of claim 15 wherein the layer of material is formed of alumina.

17. The resistor of claim 1 which further comprises means for adjusting the temperature coefficient of resistance of the resistive foil.

18. The resistor of claim 17 wherein said adjustment means is a plating formed on selected portions of the surface of the resistive foil.

19. The resistor of claim 18 wherein said plating has a high temperature coefficient of resistance.

20. The resistor of claim 19 wherein said plating is formed of a material selected from the group consisting of copper, nickel and gold.

21. The resistor of claim 17 wherein said adjustment means is a material having a high temperature coefficient of resistance connected in series with said resistor.

22. The resistor of claim 17 wherein said adjustment means is a material having a high temperature coefficient of resistance connected in parallel with said resistor.

23. The resistor of claim 1 wherein a plurality of resistors are formed on a single substrate, and comprising a plurality of resistive foils cemented to a common substrate.

* * * * *